US007219592B2

(12) United States Patent
Nielsen et al.

(10) Patent No.: US 7,219,592 B2
(45) Date of Patent: May 22, 2007

(54) VALVE ARRANGEMENT AND HYDRAULIC DRIVE

(75) Inventors: Brian Nielsen, Soenderborg (DK); Poul Erik Hansen, Gjern (DK); Torben Ole Andersen, Aalborg (DK)

(73) Assignee: Sauer-Danfoss ApS, Norborg (DK)

( * ) Notice: Subject to any disclaimer, the term of this patent is extended or adjusted under 35 U.S.C. 154(b) by 191 days.

(21) Appl. No.: 10/930,400

(22) Filed: Aug. 31, 2004

(65) Prior Publication Data

US 2005/0051025 A1 Mar. 10, 2005

(30) Foreign Application Priority Data

Sep. 3, 2003 (DE) ..... 103 40 504

(51) Int. Cl.
*F15B 11/08* (2006.01)

(52) U.S. Cl. ..... 91/437; 91/455

(58) Field of Classification Search ..... 91/455, 91/437

See application file for complete search history.

(56) References Cited

U.S. PATENT DOCUMENTS 4,537,029 A * 8/1985 Gunda et al. ..... 91/516
4,753,157 A * 6/1988 Lonnemo et al. ..... 91/455
4,840,111 A 6/1989 Garnjost
5,138,838 A 8/1992 Crosser
5,197,508 A * 3/1993 Gottling et al. ..... 137/625.4
5,568,759 A 10/1996 Aardema
5,960,695 A 10/1999 Aardema et al.
6,244,048 B1 * 6/2001 Tanaka et al. ..... 91/454
6,467,264 B1 10/2002 Stephenson et al.

FOREIGN PATENT DOCUMENTS

WO WO 96/27051 9/1996

* cited by examiner

*Primary Examiner*—F. Daniel Lopez
(74) *Attorney, Agent, or Firm*—McCormick, Paulding & Huber LLP

(57) ABSTRACT

The invention concerns a valve arrangement for controlling a hydraulic drive, the supply to and the outflow from the hydraulic drive being separately controllable. It is endeavoured to realise separate controls of the speed and the hydraulic pressure of the hydraulic drive. For this purpose, a pump pipe is connected with a first control valve, the first control valve is connected through a pipe with a first working connection and a second working connection of the hydraulic drive, and the first working connection is connected with a second control valve and the second working connection is connected with a third control valve, the second control valve and the third control valve opening into a tank (T).

15 Claims, 1 Drawing Sheet

VALVE ARRANGEMENT AND HYDRAULIC DRIVE

CROSS-REFERENCE TO RELATED APPLICATIONS

This application is entitled to the benefit of and incorporates by reference essential subject matter disclosed in German Patent Application No. 103 40 504.6 filed on Sep. 3, 2003.

FIELD OF THE INVENTION

The invention concerns a valve arrangement for controlling a hydraulic drive, the supply to and the outflow from the hydraulic drive being separately controllable. Further, the invention concerns a hydraulic drive, which is controllable with a valve arrangement.

BACKGROUND OF THE INVENTION

From the general state of the art, valve arrangements for controlling hydraulic drives are known, in which the control openings for controlling the supply to, and the outflow from the hydraulic drive are connected with each other mechanically or hydraulically. It is often desirable to be able to control the hydraulic drive with a certain speed for all load situations. With valve arrangements, whose control openings for controlling the supply to, and the outflow from the hydraulic drive are connected with each other, in which the speed of the hydraulic drive and the load acting upon the hydraulic drive have the same direction, and in which the supply is controlled, the speed of the hydraulic drive is achieved through a limitation of the outflow. However, this has a negative influence on energy efficiency. Other valve arrangements with connected control openings for controlling the supply to, and the outflow from the hydraulic drive are dimensioned so that both the supply to, and the outflow from the hydraulic drive can be controlled independently of the load. These valve arrangements have a predetermined relation between the supply and the outflow, which also results in poor energy efficiency. Depending on the load direction of the hydraulic drive, avoiding cavitation in such valve arrangements requires several valves, which makes the complete valve arrangement very labor intensive and expensive. For solving these problems, EP 0 809 737 B1, U.S. Pat. No. 5,138,838, U.S. Pat. No. 5,568,759 and U.S. Pat. No. 5,960,695 describe valve arrangements, with which the supply to and the outflow from the hydraulic drive can be controlled separately. However, these solutions do not meet the heavy demands, which exist with regard to the minimum permissible leakage flows at the working connections, when the valves are not active. In operation modes, in which the speed and the load acting upon the hydraulic drive act in the same direction, the speed is controlled by a supply pipe acted upon by the pump pressure, which also results in a poor energy efficiency. U.S. Pat. No. 4,840,111 and U.S. Pat. No. 6,467,264 attempt to avoid the high pressure in the pump line, however, their solution proposals require an unnecessarily high pressure in the tank pipe when lowering the loads, to avoid cavitation. Due to throttling losses, the consequence of the high pressure in the tank pipe is also poor energy efficiency.

SUMMARY OF THE INVENTION

The invention is based on the task of improving a valve arrangement, in such a manner that the speed and the hydraulic pressure of the hydraulic drive can be controlled independently of each other.

The invention solves this problem in that a pump pipe is connected with a first control valve, the first control valve is connected through a pipe with a first working connection and a second working connection of the hydraulic drive, and the first working connection is connected with a second control valve and the second working connection is connected with a third control valve, the second control valve and the third control valve opening into a tank.

With this valve arrangement, the speed of the hydraulic drive can be controlled independently of the hydraulic pressure. The valve arrangement according to the invention provides two basic control possibilities. In the first control possibility, the outflow amount and the hydraulic pressure at the supply are controlled independently of each other. Thus, activating the third control valve changes the speed of the hydraulic drive, and activating the first control valve changes the hydraulic pressure. In the second possibility, the supply and the hydraulic pressure at the outflow are controlled independently of each other. Thus, activating the first control valve sets the speed and activating the third control valve sets the hydraulic pressure. The independent change of the speed and the hydraulic pressure will reliably prevent cavitations and ensure improved energy efficiency, as unnecessarily high pressures are no longer required for the speed control. Here, the term "pump pipe" must be understood functionally, that is, it is not required for the pump pipe to be directly connected with a pump. Also an indirect connection with a pump or the connection with another pressure source is possible.

In an embodiment of the present invention, the first control valve and/or the second control valve and/or the third control valve are provided with a position transmitter. Further, the pump pipe and/or the tank pipe can have a pressure sensor, and both the first working connection and the second working connection can have a pressure sensor. By means of the pressure sensors, the pressures presently ruling in the pipes and at the working connections can be determined accurately. With the position transmitters, the individual valve positions and their corresponding valve throttling openings determining the flow amount can be determined. Thus, an exact control of the speed of the hydraulic drive and the hydraulic pressures, independently of each other, is possible.

In a further embodiment of the invention, a fourth control valve is located between the two working connections. The fourth control valve can be a discrete control valve or a proportional valve. In this way, a direct flow between the two working connections can be realised, which can, depending on the design of the control valve, be completely open or completely closed or throttled in an intermediate area.

Preferably, the control valves are adjustable directly and/or by a pressure control and/or by a directional control. Thus, the valve arrangement is very well suited for being programmed to certain operation modes. Whether the control valves are adjustable directly, by pressure or by directional control, the drives for the second control valve and the third control valve can be either two unidirectional drives or one bi-directional drive.

The first control valve can be a 3/3-way valve and the second, third and fourth control valves can be 2/2-way valves. Such directional valves are standard components, so that the valve arrangement can be realised in a simple and cheap manner.

Each control valve can be driven by an electromagnet and a spring. Thus, when not activated, the control valves can be switched to a preferred resting position. In this preferred resting position, the control valves could, for example, be closed to avoid the possibility of a sudden current failure causing a load, which is being lifted or lowered by the hydraulic drive, to fall to the ground.

A first backflow preventer can be located between the first control valve and the first working connection, and a second backflow preventer can be located between the first control valve and the second working connection, said backflow preventers being, for example, non-return valves. The task of these backflow preventers is to prevent an undesired leakage flow at the two working connections of the hydraulic drive, when the control valves are not activated.

In order to simplify the whole design of the valve arrangement, it is expedient to put it together in one or more valve blocks. Therefore, it is, for example, advantageous to put together the second control valve and the third control valve and the position transmitters interacting with them in one single block. In this connection it may be expedient also to adopt the backflow preventers in the block. In this case a completely tight unit is achieved, which can, for example, be mounted directly on the cylinder.

In a further embodiment of the invention, the valve arrangement comprises at least one electronic device for controlling the flow. From the pressure sensors, particularly the pressure sensors measuring the pressures at the working connections, the electronic unit for controlling the flow receives the individual actual pressures. These two actual pressures are compared with each other. On the basis of this comparison, a correction size for the valve opening is determined, which is passed on to an adjusting member connected with the valve to be controlled.

Advantageously, the hydraulic motor can be a rotary motor or a translatory motor.

BRIEF DESCRIPTION OF THE DRAWINGS

In the following, an embodiment of the invention is explained in detail on the basis of the enclosed drawings, showing.

DETAILED DESCRIPTION OF THE PREFERRED EMBODIMENTS

Figure 1:
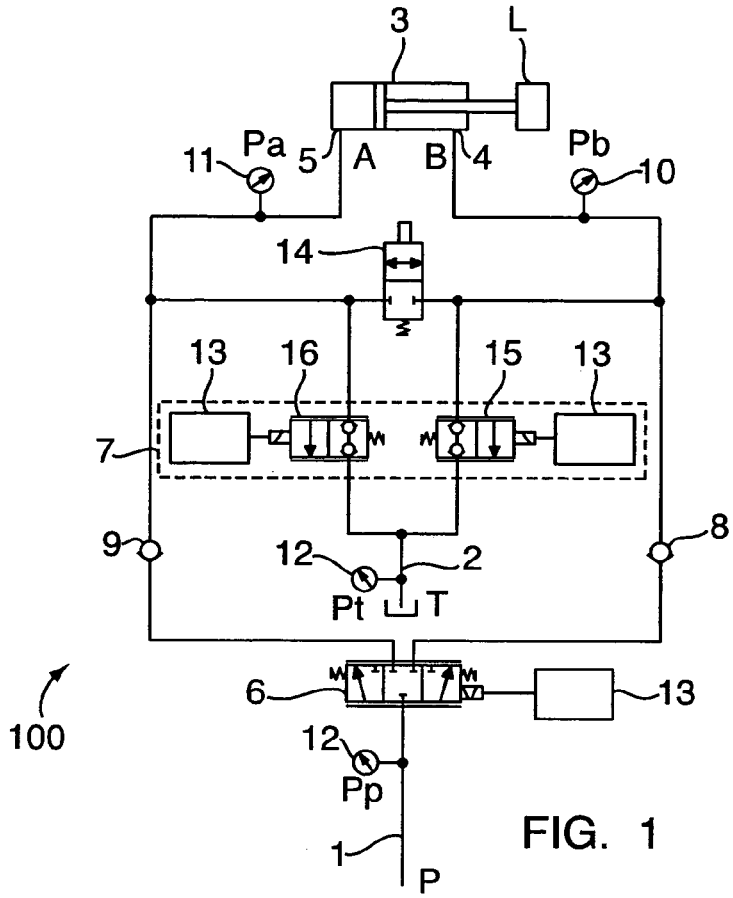
FIG. 1 is a diagram of a valve arrangement

FIG. 1 shows a valve arrangement 100 having a pump pipe 1, a tank pipe 2 and a hydraulic drive 3, which is provided with working connections 4 and 5. A first throttleable control valve 6 controls the flow amount from the pump pipe 1 to one of the working connections 4 or 5. A second throttleable control valve 15 and a third throttleable control valve 16 control the flow amount, which flows off from the hydraulic drive 3 via the working connections 4 and 5 into a tank T. Further, a fourth control valve 14 is located between the working connections 4 and 5. A first non-return valve 8 and a second non-return valve 9 are located in two pipes between the first control valve 6 and the hydraulic drive 3. A first pressure sensor 10 and a second pressure sensor 11 measure the hydraulic pressure at the working connections 4 and 5. Depending on the operation mode, a third pressure sensor 12 is located either in the pump pipe 1 or in the tank pipe 2. However, it is also possible to locate the third pressure sensor 12 in both the pump pipe 1 and the tank pipe 2 to permit the use of several operation modes without alterations. Position transmitters 13 are connected with the control valves 6, 15 and 16.

Figure 2:
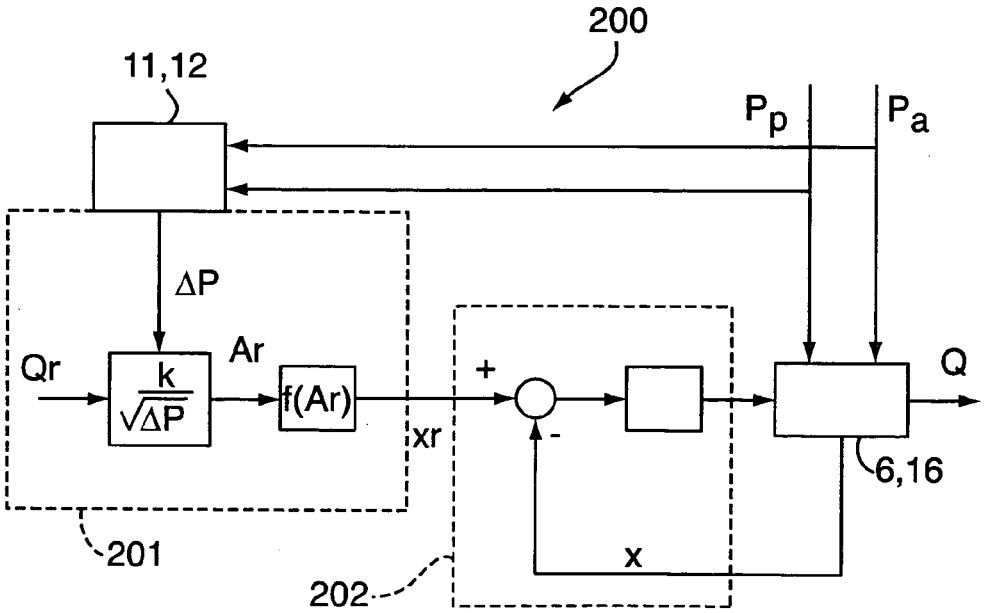
FIG. 2 is a diagram of an electronic device for measuring and controlling the flow

FIG. 2 shows an electronic device 200 for measuring and controlling the flow, particularly for controlling the control valves 6 and 16 or others. The pressure sensors 11 and 12 measure the instant actual pressure and pass it on to a calculator 201, which compares the actual pressure with a preset desired pressure, determining a differential pressure on the basis of this comparison. Together with this differential pressure, a set desired value $Q_r$ for the flow and a valve constant k, a desired valve opening $A_r$ and based on that a desired valve position $x_r$ are determined. Subsequently, the calculated values are passed on to an adjusting member 202, which sets, according to the operation mode, the control valve 6 or 16 or others at the desired value for the flow amount. In many cases, the adjusting member is part of a microprocessor.

With the described valve arrangement 100 and the electronic device 200, a number of multiplex operation modes are possible, which will be described in detail in the following. In a first operation mode, the hydraulic fluid can flow from P to B and from A to T. For this flow direction, there are two control possibilities. In the first control possibility, the control valves 14 and 15 are blocked. The outflow and the hydraulic pressure are controlled at the supply, the speed of the hydraulic drive 3 being changed by activating the control valve 16 and the hydraulic pressure at the hydraulic drive 3 being changed by activating the control valve 6. For this purpose, the pressure sensor 12 is connected in the tank pipe 2 and the position transmitter 13 is connected with the control valve 16. The desired value for the valve opening 16 is calculated by means of the hydraulic pressure measured in the working connection 5, the hydraulic pressure measured in the tank pipe 2 and by means of the desired flow opening of the control valve 16 or by means of the desired speed of the hydraulic drive 3. This calculation of the desired value of the valve position of the valve 16 is made in the manner shown in FIG. 2. When the speed and the load acting upon the hydraulic drive 3 are oppositely directed, the valve position of the control valve 6 is controlled according to a desired and to the measured hydraulic pressure at the working connection 5. Alternatively, the valve position of the control valve 6 can be controlled by means of the desired and the measured hydraulic pressures at the working connections 4 and 5. When the speed of the hydraulic drive and the load acting upon the hydraulic drive 3 act in the same direction, the valve position of the control valve 6 is controlled by means of the desired and the measured hydraulic pressure at the working connection 4. Alternatively, the valve position of the control valve 6 can be controlled by means of the desired and the measured hydraulic pressures at the working connections 4 and 5.

In a second control possibility, the supply amount and the hydraulic pressure at the outflow are controlled, the speed of the hydraulic drive 3 being changed by means of an activation of the first control valve 6 and the hydraulic pressure at the hydraulic drive 3 being changed by means of an activation of the control valve 16. For this purpose, the pressure sensor 12 is located in the pump pipe 1 and the position transmitter is connected with the control valve 6. The desired value for the valve opening of the control valve 6 is calculated by means of the hydraulic pressure ruling at the working connection 4, the pressure in the pump pipe 1 and by means of the desired flow through the control valve 6 or the desired speed of the hydraulic drive 3. Again, the calculation is made on the basis of the diagram shown in FIG. 2. Both in the case, where the speed and the load act in the same direction and in the case, where they act in opposite directions, the opening of the control valve 16 is set on the basis of the desired and the measured hydraulic pressure at the working connection 4.

When the flow takes place in the opposite direction, that is, from P to A and from B to T, the control of the speed and the hydraulic pressure can take place in the same manner, the control valve 15 being controlled instead of the control valve 16. The control valves 14 and 16 are blocked for both flow directions.

In a further operation mode for controlling the speed when lowering a load L, there is a risk of cavitation at the first working connection 4, as, with practically all speeds of the hydraulic drive 3, the outflow amount at the working connection 5 can be larger than the supply amount at the working connection 4. Then, the control valve 14 is opened or throttled. The speed of the hydraulic drive 3 is then controlled by the supply amount at the working connection 4 or by the outflow amount at the working connection 5, a part of the outflow amount of the supply amount being recyclable—due to the differential area of the cylinder.

The speed of the hydraulic drive 3 when lifting or lowering is controlled by a throttling of the control valve 14 and by a pressure change at the working connection 4 by means of the control valve 6. The flow direction to the tank T is determined by one of the two control valves 15 or 16, the other control valve 16 or 15 remaining closed. This operation mode requires the pressure sensor 12, which is located in the tank pipe 2, and the position transmitters 13, which are located at the control valves 15 and 16. The control valve 14 can always be used, no matter which of the control valves 15 or 16 is open or closed and no matter whether the position transmitters 13 are located on the control valves 15 and 16 or on the control valve 6.

A hydraulic connection between the two working connections 4 and 5 through the opened control valve 14 is also possible when lifting the load L. Here, the hydraulic fluid is supplied to the largest chamber of the hydraulic drive 3. The control valve 6 controls the supply to the hydraulic drive 3. In this operation mode, the pressure sensor 12 is located in the pump pipe 1 and the position transmitter 13 is located on the control valve 6. With a very accurate speed control, the control valve 14 can be throttled. When the load is lifted, the valve 6 controls or determines the movement. Then the pressure sensor 12 is located in the tank pipe 2 and the position transmitters 13 are located on the control valves 15 and/or 16.

In an operation mode, in which, for example, a jerky pulling movement is performed, hydraulic fluid flows from the working connection 5 to the hydraulic drive 3, the supply being controlled by the control valve 6. Such an operation mode occurs, for example, during operation of a tractor, particularly when controlling the tool bar, that is, a lifting device, which, for example, carries a plough. Here, the control valve 15 serves as relief valve, so that the hydraulic pressure at the working connection 4 drops. When the hydraulic pressure at the working connection 4 has dropped below a certain pressure level, the hydraulic drive 3 moves in the opposite direction, choosing either the operation mode, in which the flow is from P to B and from A to T, or the operation mode, in which the working connections 4 and 5 are hydraulically connected with each other during the lowering of a load.

In a further operation mode it is required that the two working connections are connected with the tank pipe 2, the working connections 4 and 5 being pressureless. This is achieved through a complete opening of the control valves 15 and 16 or the control valves 14 and 15 or the control valves 14 and 16. The remaining valves must then remain closed.

In another operation mode undesirable leakage flows at the working connections 4 and 5 are avoided. Such leakage flows are, for example, undesirable, when the hydraulic drive 3 has to hold a load in a certain period for some time. This is achieved by means of the backflow preventers 8 and 9 and the closed control valves 6, 14, 15 and 16.

When comparing the large number of application possibilities of this relatively simple valve arrangements with the already existing valve arrangements, it appears that, depending on the operation mode chosen, the valve arrangement needs maximum one or two position transmitters and maximum three pressure sensors.

What is claimed is:

1. A valve arrangement for controlling a hydraulic drive wherein the supply to and the outflow from the hydraulic drive are separately controllable, the valve arrangement comprising:

a first control valve for controlling the inflow from a pump pipe to first and second working connections of the hydraulic drive;

a second control valve for controlling the outflow from the first working connection of the hydraulic drive to a tank;

a third control valve for controlling the outflow from the second working connection of the hydraulic drive to the tank; and at least one electronic device for controlling the control valves;

wherein only the inflow to the hydraulic drive from the pump pipe passes through the first control valve and only the outflow to the tank passes through the second and third control valves.

2. The valve arrangement according to claim 1, wherein at least one of the first control valve, the second control valve, and the third control valve is provided with a position transmitter.

3. The valve arrangement according to claim 1, wherein at least one of the pump pipe and the tank pipe has a pressure sensor.

4. The valve arrangement according to claim 1, wherein the first working connection and the second working connection each have a pressure sensor.

5. The valve arrangement according to claim 1, wherein the control valves are adjustable by at least one of directly, by a pressure control, and by a directional control.

6. The valve arrangement according to claim 1, wherein the first control valve is a 3/3-way valve.

7. The valve arrangement according to claim 1, wherein the second and third control valves are 2/2-way valves.

8. The valve arrangement according to claim 1, wherein each control valve is driven by an electromagnet and a spring.

9. The valve arrangement according to claim 1, wherein a first backflow preventer is located between the first control valve and the first working connection, and a second backflow preventer is located between the first control valve and the second working connection.

10. The valve arrangement according to claim 9, wherein the backflow preventers are non-return valves.

11. The valve arrangement according to claim 1, wherein the valve arrangement is put together in one or more valve blocks.

12. The valve arrangement according to claim 1, wherein the hydraulic drive is one of a rotary motor and a translatory motor.

13. A valve arrangement for controlling a hydraulic drive wherein the supply to and the outflow from the hydraulic drive are separately controllable, the valve arrangement comprising:

a first control valve connected with a pump pipe, and first and second working connections of the hydraulic drive;

a second control valve connected with the first working connection and opening into a tank;

a third control valve connected with the second working connection and opening into the tank; and a fourth control valve connecting the first and second working connections.

14. The valve arrangement according to claim 13, wherein the fourth control valve is one of a discrete control valve and a proportional valve.

15. A valve arrangement for controlling a hydraulic drive wherein the supply to and the outflow from the hydraulic drive are separately controllable, the valve arrangement comprising:

a first control valve connected with a pump pipe, and first and second working connections of the hydraulic drive;

a second control valve connected with the first working connection and opening into a tank; and a third control valve connected with the second working connection and opening into the tank;

wherein the valve arrangement is put together in one or more valve blocks; and wherein the second control valve and the third control valve and position transmitters are put together in one block.

* * * * *